United States Patent [19]

Costello et al.

[11] 4,126,447

[45] Nov. 21, 1978

[54] LANTHANUM-MODIFIED HIGH-TEMPERATURE ALLOY

[75] Inventors: Thomas M. Costello; Jerome P. Bressanelli, both of, Pittsburgh, Pa.

[73] Assignee: Crucible Inc., Pittsburgh, Pa.

[21] Appl. No.: 847,342

[22] Filed: Oct. 31, 1977

[51] Int. Cl.[2] ..... C22C 30/00

[52] U.S. Cl. ..... 75/122; 75/128 E; 75/134 F

[58] Field of Search ..... 75/122, 134 F, 128 E, 75/128 W, 128 C, 128 A, 125 N, 125 T, 125 F, 124

[56] References Cited

U.S. PATENT DOCUMENTS

| | | | |
|---|---|---|---|
| 2,553,330 | 5/1951 | Post et al. | 75/128 E |
| 3,758,294 | 9/1973 | Bellot et al. | 75/134 F |
| 3,947,266 | 3/1976 | Culling | 75/134 F |
| 4,039,330 | 8/1977 | Shaw | 75/134 F |
| 4,063,934 | 12/1977 | Thuillier et al. | 75/134 F |

FOREIGN PATENT DOCUMENTS

| | | | |
|---|---|---|---|
| 1,190,047 | 4/1970 | United Kingdom | 75/134 F |

*Primary Examiner*—Arthur J. Steiner

[57] ABSTRACT

A high-temperature steel of chromium, nickel and tungsten modified with a lanthanum addition and balanced compositionally to provide a combination of good oxidation resistance and high temperature strength; chromium is present within the range of 19 to 22%, nickel is present within the range of 30 to 45%, tungsten is present within the range of 1 to 4% and lanthanum is present within the range of 0.02 to 0.25% with the lanthanum addition providing the oxidation resistance and the combination of elements being balanced to achieve structural stability and thus high strength at elevated temperature.

3 Claims, 3 Drawing Figures

LANTHANUM-MODIFIED HIGH-TEMPERATURE ALLOY

Stainless steels characterized by high temperature strength and oxidation resistance are required for use in applications such as coal gassification and liquefaction, municipal incineration, automotive gas turbines and emission control systems. Current alloys used in these applications contain nominally 20% chromium, 30% nickel with strengthening additions of elements such as tungsten and molybdenum. Chromium is required in significant amounts to contribute to oxidation resistance in alloys of this type, and correspondingly high nickel contents are necessary to insure a fully stable austenitic structure which is necessary for high temperature strength.

It is accordingly a primary object of the present invention to provide a high temperature steel that contains relatively high amounts of chromium, nickel and tungsten and is characterized by improved oxidation resistance and structural stability with attendant high temperature strength.

This and other objects of the invention as well as a more complete understanding thereof may be obtained from the following description, specific examples and drawings, in which.

Figure 1:
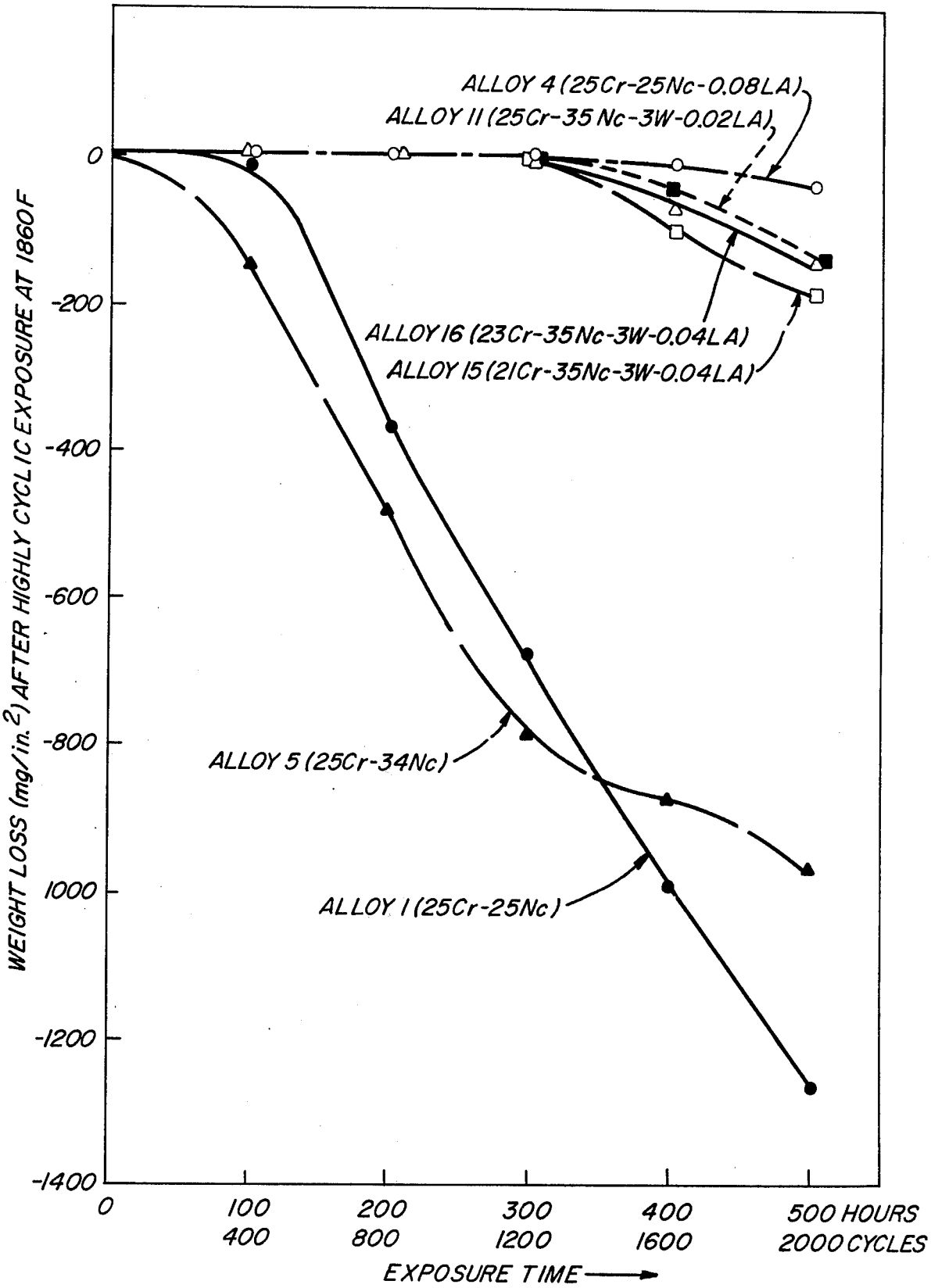
FIG. 1 is a graph showing the effect of lanthanum in alloys of the invention with respect to oxidation resistance.

Broadly, the invention achieves a combination of oxidation resistance and high temperature strength by the use of a lanthanum addition in combination with chromium, nickel and tungsten being balanced to achieve structural stability with resulting high temperature strength. Lanthanum, when combined with the chromium, promotes the formation of a highly protective chromium-rich oxide, which produces good oxidation resistance. In the alloy of this invention lanthanum together with chromium is critically controlled to provide good oxidation resistance without introducing second phases during high temperature exposure that in turn reduce creep resistance. Controlled solution strengthening additions of tungsten, with optional additions of molybdenum, to the high chromium-nickel steel base provides the desired high temperature strength when the chromium and nickel are balanced along with the other elements to prevent secondary phase formation at the elevated service temperatures.

In accordance with the invention the composition limits thereof are as follows:

| Element | Percent by Weight | | |
|---|---|---|---|
| | Broad | Preferred | Aim |
| Carbon | 0.023/0.25 | 0.02/0.15 | 0.03/0.08 |
| Manganese | 3.0 max. | 2.0 max. | 2.0 max. |
| Phosphorus | 0.040 max. | 0.040 max. | 0.040 max. |
| Sulfur | 0.030 max. | 0.030 max. | 0.030 max. |
| Silicon | 2.0 max. | 1.0 maX. | 0.2/0.7 |
| Chromium | 19/22 | 19/22 | 20/21.5 |
| Nickel | 30/45 | 30/40 | 34/36 |
| Molybdenum | up to 1.0 | up to 0.50 | up to 0.50 |
| Tungsten | 1 to 4.0 | 2.0/4.0 | 2.5/3.5 |
| Nitrogen | 0.01/0.15 | 0.01/0.10 | 0.02/0.07 |
| Titanium | 0.50 max. | 0.50 max. | 0.20 max. |
| Aluminum | 0.50 max. | 0.50 max. | 0.30 max. |
| Lanthanum | 0.02/0.25 | 0.02/0.15 | 0.02/0.08 |
| Boron | 0.010 max. | 0.010 max. | 0.0005/0.008 |
| Iron | Balance | Balance | Balance |

and where the combination of elements must satisfy the following equation $$\%\,Cr + 1.75\,(\%\,W) + 4.25\,(\%\,Mo) + 1.5\,(\%\,Si) + 2.5\,(\%\,Ti) + 3.0\,(\%\,Al) - 0.52\,(\%\,Ni) = <9.0$$

In defining the invention the alloys reported on Table I were used.

Carbon content is in the range specified to provide good corrosion and oxidation resistance and to promote a fully austenitic structure. Although higher carbon acts to increase the strength properties of austenitic stainless steels, it more importantly reduces oxidation and corrosion resistance and it impairs hot workability and hot rollability.

Manganese is restricted to the range commonly observed in commercial austenitic stainless steels. Manganese is specified in this range since higher manganese levels reduce scaling resistance.

Although higher silicon contents are known to promote improved scaling resistance, silicon is restricted to the relatively low levels shown above to promote a stable austenitic structure free from second phase (sigma or chi) formation during service.

Nitrogen is in the range specified to promote a fully stable austenitic structure. Although higher nitrogen levels increase strength properties, commercial processing (hot and cold workability) is impaired.

Boron is added for its effects on improving elevated temperature strength properties.

Titanium and aluminum are restricted to the specified levels to insure the formation of a stable austenitic structure. As shown later in chromium equivalent considerations, titanium and particularly aluminum are potent sigma formers in chromium-nickel-iron alloys and for this reason are restricted to the relatively low levels shown above. The criticality of the remaining compositional elements of steels of this invention are given in the following discussion.

TABLE I

CHEMICAL COMPOSITIONS OF HEAT RESISTANT STAINLESS STEELS

| Alloy | Heat | C | Mn | Si | Cr | Ni | W | Mo | N | La | Chromium Equivalent |
|---|---|---|---|---|---|---|---|---|---|---|---|
| 1 | 1K45 | .058 | 1.83 | .54 | 24.38 | 24.89 | — | — | .06 | — | 12.24 |
| 2 | 1K46 | .060 | 1.68 | .51 | 24.72 | 24.61 | 1.84 | — | .06 | — | 15.90 |
| 3 | 1K47 | .051 | 1.61 | .46 | 24.75 | 24.69 | .98 | .91 | .06 | — | 18.2 |
| 4 | FF | .062 | 1.66 | .82 | 24.92 | 24.95 | — | — | .03 | .08 | 13.2 |
| 5 | SCl | .043 | 1.29 | .58 | 24.80 | 33.70 | — | — | .03 | — | 8.1 |
| 6 | 3957 | .074 | 1.64 | .35 | 24.41 | 34.46 | — | — | .04 | .17 | 7.0 |
| 7 | 3961 | .068 | 1.57 | .43 | 24.74 | 34.55 | — | .84 | .04 | .21 | 11.0 |
| 8 | 3962 | .068 | 1.57 | .44 | 24.71 | 34.82 | .93 | — | .04 | .22 | 8.9 |
| 9 | 3A5 | .068 | 1.79 | .54 | 24.31 | 33.97 | 1.11 | .28 | .04 | .02 | 10.6 |
| 10 | 3A6 | .062 | 1.78 | .52 | 24.71 | 34.58 | 2.04 | .28 | .05 | .02 | 12.3 |

TABLE I-continued

CHEMICAL COMPOSITIONS OF HEAT RESISTANT STAINLESS STEELS

| Alloy | Heat | C | Mn | Si | Cr | Ni | W | Mo | N | La | Chromium Equivalent |
|---|---|---|---|---|---|---|---|---|---|---|---|
| 11 | 3A7 | .064 | 1.75 | .46 | 24.83 | 34.71 | 3.21 | .26 | .04 | .02 | 14.2 |
| 12 | 3A10 | .070 | 1.83 | .51 | 24.52 | 38.52 | 1.89 | .26 | .04 | .03 | 9.7 |
| 13 | 3A12 | .058 | 1.82 | .55 | 24.45 | 42.87 | 2.96 | .30 | .04 | .03 | 9.4 |
| 14 | 3985 | .071 | 1.99 | .60 | 24.01 | 44.86 | 1.89 | .34 | .04 | .04 | 6.3 |
| 15 | 3A18 | .061 | 1.56 | .51 | 20.74 | 34.67 | 2.85 | — | .04 | .04 | 8.5 |
| 16 | 3A19 | .071 | 1.73 | .53 | 23.50 | 35.21 | 2.86 | — | .05 | .04 | 11.0 |
| 17 | 32X* | .07 | .55 | .55 | 21.0 | 31.0 | 3.0 | — | — | — | 12.9 |

*Alloy 32X also contains 0.35% Al and 0.35% Ti

In conventional chromium-nickel austenitic stainless steels it was found that optimum oxidation (scaling) resistance was obtained with alloys containing about 25% chromium. The effect of lanthanum with respect to oxidation resistance on alloys with this chromium content is shown in FIG. 1 of the drawings. More specifically, as may be seen from FIG. 1 alloys 1 and 5 had chromium contents of 25% with no lanthanum addition; whereas, alloys 4, 11, 16 and 15 had lanthanum additions of 0.08%, 0.02%, 0.04% and 0.04%, respectively. These lanthanum-containing alloys at the same or even at slightly lower chromium contents exhibited drastically improved oxidation resistance during cyclic exposure at 1860° F for times ranging from 100 to 500 hours. Substantially no oxidation, as exhibited by weight loss, was experienced with the lanthanum-containing alloys at times up to approximately 300 hours under cyclic test conditions. In accordance with the invention, lanthanum may be added within the composition limits defined herein in a form wherein it is combined with other rare-earth elements, an example being misch metal. In the lanthanum-modified alloys of the invention, the amount of chromium required to provide scaling resistance can, as shown by the data presented in FIG. 1, be reduced from the conventional amount of approximately 25% in alloys of the type to about 19 to 20 or 22% chromium. This is highly significant because lower chromium is needed to prevent second phase (sigma) formation during high temperature exposure and freedom from sigma is necessary for good elevated temperature strength as shown later. As discussed hereinabove, high temperature strength in combination with oxidation resistance is a necessary combination of properties for alloys of this type.

TABLE II

EFFECTS OF DIFFERENT TUNGSTEN AND MOLYBDENUM CONTENTS ON THE CREEP RESISTANCE OF 25Cr-Ni HEAT RESISTANT STAINLESS STEELS

| | | Nominal Composition | | | | Creep Resistance % Elongation After 1000 Hours Exposure at Indicated Exposure Temperature and Stress | |
|---|---|---|---|---|---|---|---|
| Alloy | Heat | Cr | Ni | W | Mo | 1700° F (1250 psi) | 1500° F (4000 psi) |
| 1 | 1K45 | 24.4 | 24.9 | Nil | Nil | 7.1 | 8.4 |
| 2 | 1K46 | 24.7 | 24.6 | 1.8 | Nil | 2.7 | 41.4 |
| 3 | 1K47 | 24.7 | 24.6 | 1.0 | 0.9 | 3.5 | 42.4 |
| 6 | 3957 | 24.4 | 34.5 | Nil | Nil | 3.53 | — |
| 7 | 3961 | 24.7 | 34.5 | Nil | 0.8 | 0.86 | 5.9 |
| 8 | 3962 | 24.7 | 34.8 | 0.9 | Nil | 1.88 | 4.8 |

The strength studies reported in TABLE II indicate that tungsten, with optional molybdenum additions, are effective in improving high temperature creep properties of alloys containing 25% chromium and 25% to 35% nickel. Tungsten is employed and is preferred over molybdenum because it does not promote embrittlement caused by secondary phase formation during extended exposure at high service temperatures.

TABLE III

EFFECT OF SOLUTION STRENGTHENING ADDITIONS OF TUNGSTEN ON THE HIGH TEMPERATURE STRENGTH OF 25Cr-35Ni STAINLESS STEELS

| | | Compositional Variant* | uz,16/33 Tension Creep Tests % Elongation After 1000 Hours Exposure at 1700° F Under Applied Stress at 750 psi | Cantilever Beam Creep Test Deflection (inches) After 100 Hours Exposure at Indicated Temperature and Stress | | |
|---|---|---|---|---|---|---|
| Alloy | Heat | W | | 1500° F 2530 psi | 1700° F 1000 psi | 1900° F 410 psi |
| 9 | 3A5 | 1.0 | 5.9 | 0.26 | 0.48 | 2.68 |
| 10 | 3A6 | 2.0 | 25.7 | 0.42 | 0.60 | 3.05 |
| 11 | 3A7 | 3.0 | 15.8 | 1.30 | 1.05 | 3.06 |

*Base composition C 0.06, Cr 25.0, Ni 35.0, La 0.02/0.03

The importance of structural stability and its effect on high temperature strength is demonstrated by the results presented in Table III. Although it might be expected that increasing additions of tungsten would improve the creep resistance of alloys of this type these results show that creep strength is actually reduced in the presence of secondary phase formation during high temperature exposure. Consequently, in accordance with the invention it is necessry when using tungsten or molybdenum for this purpose to adjust the base composition, particularly chromium and nickel, to avoid this secondary phase formation and achieve improved creep resistance.

TABLE IV

EFFECT OF CHROMIUM AND NICKEL CONTENTS ON THE CREEP RESISTANCE OF HIGH CHROMIUM-HIGH NICKEL-TUNGSTEN HEAT RESISTANT STAINLESS STEELS

| | | Nominal Composition | | | Tension Creep Tests: % Elongation After 1000 Hours Exposure at Indicated Temperature and Stress | Cantilever Beam Creep Tests: Deflection (inches) After 100 Hours Exposure at Indicated Temperature and Stress | | |
|---|---|---|---|---|---|---|---|---|
| Alloy | Heat | Cr | Ni | W | 1700° F (750 psi) | 1500° F 2530 psi | 1700° F 1000 psi | 1900° F 410 psi |
| Chromium Series | | | | | | | | |
| 15 | 3A18 | 21 | 35 | 2.9 | 1.3 | .55 | .43 | .82 |
| 16 | 3A19 | 23 | 35 | 2.9 | 18.3 | 2.93 | 1.80 | 3.14 |
| 11 | 3A7 | 25 | 35 | 3.2 | 15.8 | 1.30 | 1.05 | 3.06 |
| Nickel Series | | | | | | | | |
| 10 | 3A6 | 25 | 35 | 2.0 | 25.7 | .42 | .60 | 3.05 |
| 12 | 3A10 | 25 | 39 | 1.9 | 19.9 | 1.14 | 1.43 | 4.40 |
| 14 | 3985 | 24 | 45 | 1.9 | 20.7 | 1.20 | 1.24 | — |
| 11 | 3A7 | 25 | 35 | 3.2 | 15.8 | 1.30 | 1.05 | 3.06 |
| 13 | 3A12 | 25 | 43 | 3.0 | 13.3 | .42 | 1.01 | 2.64 |

As may be seen from the test results presented in Table IV by reducing chromium from about 25 to about 21% a stable austenitic structure free from second phase formation and having substantially improved high temperature creep resistance is achieved. By increasing the nickel content from about 35 to about 45% only marginal improvement in creep resistance is achieved. Consequently, in accordance with the composition limits of the invention one is able to achieve this improved property without going to a higher than conventional nickel content. The effect of second phase formation on creep resistance during high temperature exposure is shown in FIG. 2 of the drawings.

Figure 2:
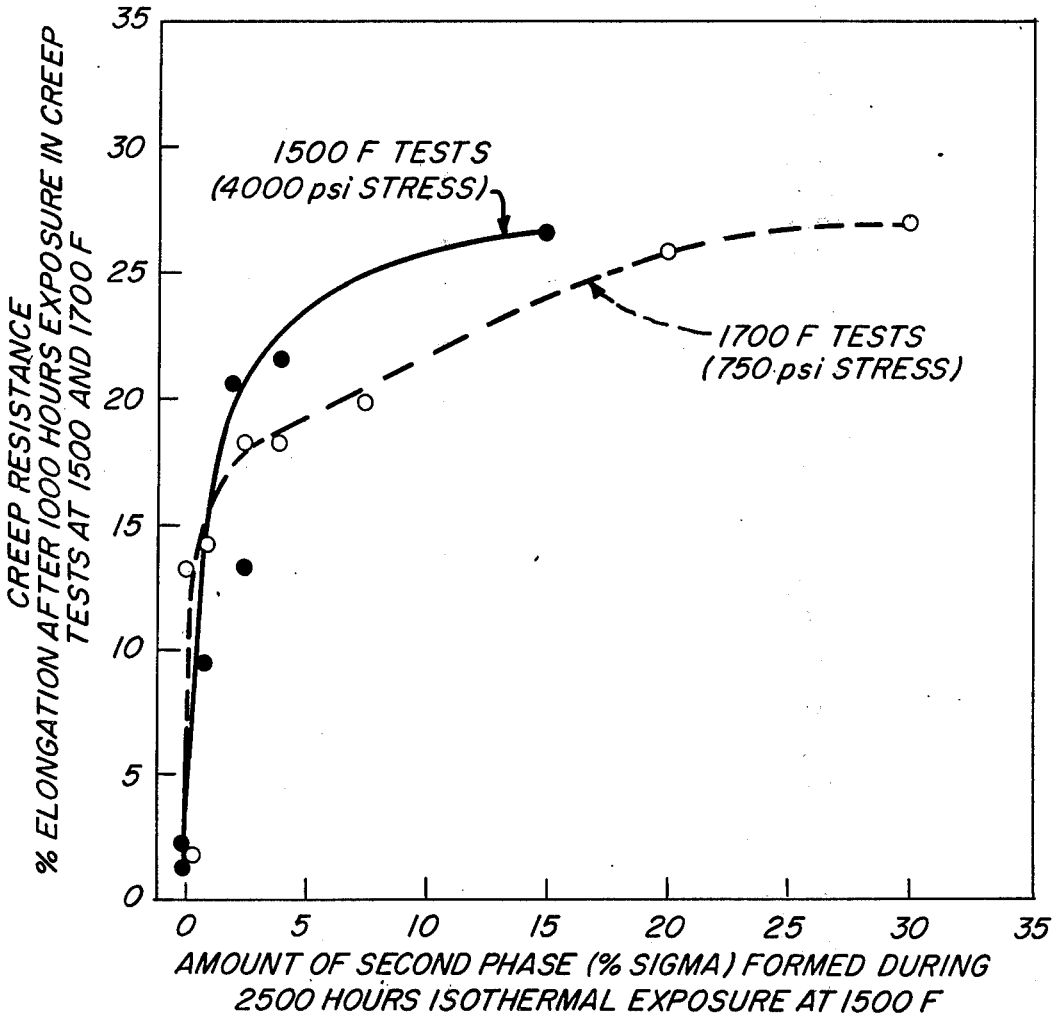
FIG. 2 is a similar graph showing the effect of secondary phase formation on the high temperature strength of the alloys.

FIG. 2 is based on data developed for alloys containing 20 to 25% chromium, 25 to 45% nickel, 0 to 3% each of molybdenum and/or tungsten and/or cobalt with the balance iron. Creep resistance, as indicated by the amount of elongation that occurs for a given alloy at either 1500° or 1700° F under sustained stresses of 4000 or 750 psi respectively, is shown as a function of the amount of sigma phase that formed in that alloy during a 2500-hour isothermal exposure at 1500° F. This later characteristic is a direct measure of the stability of an alloy to second phase formation during high temperature exposure. Sigma phase formation could not be directly measured with accuracy on creep specimens themselves after high temperature testing due to the complex deformation processes taking place during testing which obscured the sigma phase; therefore the tendency of the various alloys to sigma phase formation was indirectly determined by measuring that amount of sigma which formed in isothermally exposed specimens (at 1500° F) not subjected to simultaneous deformation processes.

Figure 3:
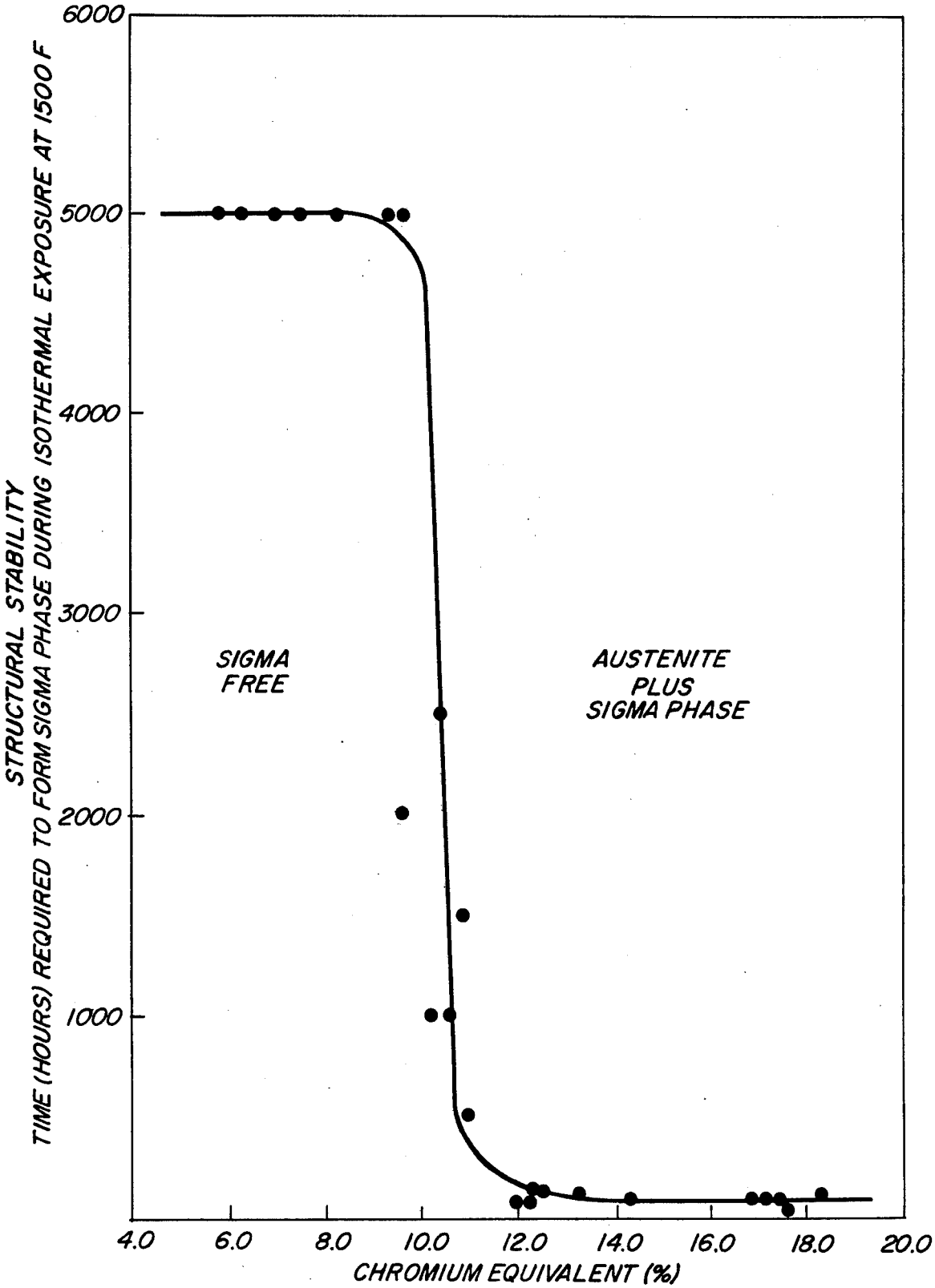
FIG. 3 is a graph showing the effect of composition on the structure stability of the alloys.

We have found, as shown in FIG. 3, that the slightest degree of structural instability, associated with sigma formation of less than about 5% at 1500° F, leads to a considerable decrease in creep resistance. This loss in creep resistance is reflected by a large increase in creep elongation. Thus, we have found that for optimum creep resistance, sigma phase must be minimized to very low levels, or preferably prevented, during high temperature exposure.

The most direct and best method to provide good creep resistance is to adjust alloy composition to insure structural stability against sigma phase formation. We have found, as shown in FIG. 3, that for good structural stability and hence good creep resistance, alloy composition must be controlled such that chromium equivalents as calculated from the following equation are equal to or less than a value of 9.0:

$$\%\,Cr + 1.75\,(\%\,W) + 4.25\,(\%\,Mo) + 1.5\,(\%\,Si) + 2.5\,(\%\,Ti) + 3.0\,(\%\,Al) - 0.52\,(\%\,Ni)$$

As indicated in FIG. 3, alloys having a chromium equivalent of greater than 9.0 from sigma in less than 5000 hours of exposure of 1500° F and, as indicated in FIG. 2, these alloys which are prone to sigma formation exhibit inferior creep resistance at either 1500° or 1700° F. Likewise, the relationship between the composition and structural stability, in terms of the time required for the initiation of sigma phase formation, is illustrated in FIG. 3. As shown by the FIG. 3 data the steels of the invention must have chromium equivalents of less than 9.0 to be structurally stable with regard to sigma formation during high temperature service.

This interdependence of alloy composition, structural stability and high temperature strength was not recognized in the prior art. One such alloy developed for high temperature service (Alloy 17, Heat 32X)* is shown in Table I. Based on the critical relationships between composition, sigma phase formation and high temperature strength, which are reflected by its chromium equivalent (12.9), this alloy would have poor high temperature strength properties compared to alloys of this invention. As shown in this invention, all compositional elements must be critically controlled to avoid sigma phase formation and thereby promote good high temperature strength properties.

*R. H. Soderberg et al., "Nickel-Chromium-Iron Alloy," U.S. Pat. No. 3,826,649; July 30, 1974.

We claim:

1. A stainless steel for use in high temperature applications characterized by good oxidation resistance and high temperature strength said stainless steel consisting essentially of, in weight percent, carbon 0.02 to 0.25, manganese 3 max., phosphorous 0.04 max., sulfur 0.03 max., silicon 2 max., chromium 19 to 22, nickel 30 to 45, molybdenum up to 1, tungsten 1 to 4, nitrogen 0.01 to 0.15, titanium 0.5 max., aluminum 0.5 max., lanthanum 0.02 to 0.25, boron 0.010 max., where the combination of elements satisfies the equation chromium equivalent equals $$\%\,Cr + 1.75\,(\%\,W) + 4.25\,(\%\,Mo) + 1.5\,(\%\,Si) + 2.5\,(\%\,Ti) + 3.0\,(\%\,Al) - 0.52\,(\%\,Ni) = <9.0$$

balance iron.

2. A stainless steel for use in high temperature applications characterized by good oxidation resistance and high temperature strength said stainless steel consisting essentially of, in weight percent, carbon 0.02 to 0.15, manganese 2 max., phosphorus 0.04 max., sulfur 0.03 max., silicon 1 max., chromium 19 to 22, nickel 30 to 40, molybdenum 0.5 max., tungsten 2 to 4, nitrogen .01 to .10, titanium 0.5 max., aluminum 0.5 max., lanthanum 0.02 to 0.15, boron 0.010 max., where the combination of elements satisfies the equation chromium equivalent equals $$\%\,Cr + 1.75\,(\%\,W) + 4.25\,(\%\,Mo) + 1.5\,(\%\,Si) + 2.5\,(\%\,Ti) + 3.0\,(\%\,Al) - 0.52\,(\%\,Ni) = <9.0$$

balance iron.

3. A stainless steel for use in high temperature applications characterized by good oxidation resistance and high temperature strength said stainless steel consisting essentially of, in weight percent, carbon 0.03 to 0.08, manganese 2 max., phosphorus 0.04 max., sulfur 0.03 max., silicon 0.2 to 0.7, chromium 20 to 21.5, nickel 34 to 36, molybdenum .5 max., tungsten 2.5 to 3.5, nitrogen 0.02 to 0.07, titanium 0.20 max., aluminum 0.30 max., lanthanum 0.02 to 0.08, boron 0.001 to 0.008, where the combination of elements satisfies the equation chromium equivalent equals $$\%\,Cr + 1.75\,(\%\,W) + 4.25\,(\%\,Mo) + 1.5\,(\%\,Si) + 2.5\,(\%\,Ti) + 3.0\,(\%\,Al) - 0.52\,(\%\,Ni) = <9.0$$

balance iron.

* * * * *

UNITED STATES PATENT OFFICE

CERTIFICATE OF CORRECTION

Patent No. 4,126,447 Dated Nov. 21, 1978

Inventor(s) Thomas M. Costello; Jerome P. Bressanelli

It is certified that error appears in the above-identified patent and that said Letters Patent are hereby corrected as shown below:

Column 2, line 5, under column headed "Broad", first chemical composition, "0.023/0.25" should be --0.02/0.25--.

Column 4, Table III, fourth column of headings, "uz, 16/33" should be deleted.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*